US007113134B1

(12) United States Patent
Berkman

(10) Patent No.: US 7,113,134 B1
(45) Date of Patent: Sep. 26, 2006

(54) TRANSFORMER ANTENNA DEVICE AND METHOD OF USING THE SAME

(75) Inventor: William H. Berkman, New York, NY (US)

(73) Assignee: Current Technologies, LLC, Germantown, MD (US)

( * ) Notice: Subject to any disclaimer, the term of this patent is extended or adjusted under 35 U.S.C. 154(b) by 75 days.

(21) Appl. No.: 10/799,975

(22) Filed: Mar. 12, 2004

(51) Int. Cl.
*H01Q 1/24* (2006.01)

(52) U.S. Cl. ..... 343/702; 343/872; 343/873

(58) Field of Classification Search ..... 343/702, 343/872, 700 MS, 873, 720; 324/142
See application file for complete search history.

(56) References Cited

U.S. PATENT DOCUMENTS

| | | | | |
|---|---|---|---|---|
| 1,547,242 A | | 7/1925 | Strieby | |
| 2,298,435 A | | 10/1942 | Tunick | 250/15 |
| 2,473,780 A | * | 6/1949 | Benioff | 178/116 |
| 2,577,731 A | | 12/1951 | Berger | 179/2.5 |
| 3,369,078 A | | 2/1968 | Stradley | |
| 3,445,814 A | | 5/1969 | Spalti | 340/151 |
| 3,605,009 A | | 9/1971 | Enge | 323/93 |
| 3,641,536 A | | 2/1972 | Prosprich | 340/870.15 |
| 3,656,112 A | | 4/1972 | Paull | 340/151 |
| 3,696,383 A | | 10/1972 | Oishi et al. | 340/310 |
| 3,702,460 A | | 11/1972 | Blose | 340/150 |
| 3,810,096 A | | 5/1974 | Kabat et al. | |
| 3,846,638 A | | 11/1974 | Wetherell | 307/3 |
| 3,895,370 A | | 7/1975 | Valentini | 340/310 |
| 3,911,415 A | | 10/1975 | Whyte | 340/310 |
| 3,942,168 A | | 3/1976 | Whyte | 340/310.01 |
| 3,942,170 A | | 3/1976 | Whyte | 340/310 |
| 3,962,547 A | | 6/1976 | Pattantyus-Abraham | 179/2.5 R |
| 3,964,048 A | | 6/1976 | Lusk et al. | |
| 3,967,264 A | | 6/1976 | Whyte et al. | 340/310.08 |
| 3,973,087 A | | 8/1976 | Fong | 179/170 R |
| 3,973,240 A | | 8/1976 | Fong | 340/151 |
| 3,980,954 A | | 9/1976 | Whyte | |
| 4,004,011 A | | 1/1977 | Whyte | 179/170 J |
| 4,004,110 A | | 1/1977 | Whyte | 179/170 J |
| 4,012,733 A | | 3/1977 | Whyte | 340/310 |
| 4,016,429 A | | 4/1977 | Vercellotti et al. | 307/149 |
| 4,053,876 A | | 10/1977 | Taylor | 340/529 |

(Continued)

FOREIGN PATENT DOCUMENTS

DE 197 28 270 A1 1/1999

(Continued)

OTHER PUBLICATIONS

Outlook Conference 2004: Amperion Deployment Overview, Primen Conference, May 7, 2004, 10 pages.

(Continued)

*Primary Examiner*—Hoanganh Le
(74) *Attorney, Agent, or Firm*—Mel Barnes; Manelli Denison & Selter PLLC

(57) ABSTRACT

The invention contemplates an antenna device, system and method of installing the antenna device for receiving a wireless signal at a pad mounted electrical transformer. The novel device includes an antenna capable of communicating the wireless signal and a material located around the antenna. The material facilitates attachment to the pad mounted electrical transformer as well as preventing access to the antenna. The antenna may be covered by or embedded within the material. The material may be emissive and/or insulative. In addition, the device may include a conductor that passes through an enclosure of the pad mounted transformer. The conductor may be communicatively coupled to a first communication device that provides communication to a customer premise that is electrically coupled to the pad mounted electrical transformer.

41 Claims, 4 Drawing Sheets

U.S. PATENT DOCUMENTS

| | | | | |
|---|---|---|---|---|
| 4,057,793 | A | 11/1977 | Johnson et al. | |
| 4,060,735 | A | 11/1977 | Pascucci et al. | |
| 4,070,572 | A | 1/1978 | Summerhayes | 250/199 |
| 4,119,948 | A | 10/1978 | Ward et al. | 340/870.02 |
| 4,142,178 | A | 2/1979 | Whyte et al. | 340/310 |
| 4,188,619 | A | 2/1980 | Perkins | 340/310 R |
| 4,239,940 | A | 12/1980 | Dorfman | |
| 4,250,489 | A | 2/1981 | Dudash et al. | 340/147 T |
| 4,254,402 | A | 3/1981 | Perkins | 340/310 R |
| 4,263,549 | A | 4/1981 | Toppeto | 324/127 |
| 4,268,818 | A | 5/1981 | Davis et al. | 340/870.38 |
| 4,323,882 | A | 4/1982 | Gajjar | 340/310 R |
| 4,357,598 | A | 11/1982 | Melvin, Jr. | 340/310 A |
| 4,359,644 | A | 11/1982 | Foord | 307/40 |
| 4,367,522 | A | 1/1983 | Forstbauer et al. | 363/137 |
| 4,383,243 | A | 5/1983 | Krügel et al. | 340/310 R |
| 4,386,436 | A | 5/1983 | Kocher et al. | 455/151.4 |
| 4,408,186 | A | 10/1983 | Howell | 340/310 A |
| 4,409,542 | A | 10/1983 | Becker et al. | 324/57 Q |
| 4,413,250 | A | 11/1983 | Porter et al. | 340/310.01 |
| 4,419,621 | A | 12/1983 | Becker et al. | 324/51 |
| 4,433,284 | A | 2/1984 | Perkins | 323/361 |
| 4,442,492 | A | 4/1984 | Karlsson et al. | 364/464 |
| 4,457,014 | A | 6/1984 | Bloy | 381/98 |
| 4,468,792 | A | 8/1984 | Baker et al. | 375/45 |
| 4,471,399 | A | 9/1984 | Udren | 361/64 |
| 4,473,816 | A | 9/1984 | Perkins | 340/310 |
| 4,473,817 | A | 9/1984 | Perkins | 340/310 |
| 4,475,209 | A | 10/1984 | Udren | 375/4 |
| 4,479,033 | A | 10/1984 | Brown et al. | 179/2.51 |
| 4,481,501 | A | 11/1984 | Perkins | 340/310 |
| 4,495,386 | A | 1/1985 | Brown et al. | 455/402 |
| 4,517,548 | A | 5/1985 | Ise et al. | 340/310 R |
| 4,569,045 | A | 2/1986 | Schieble et al. | 370/85 |
| 4,599,598 | A | 7/1986 | Komoda et al. | 340/310 A |
| 4,642,607 | A | 2/1987 | Strom et al. | 340/310 |
| 4,644,321 | A | 2/1987 | Kennon | 340/310 A |
| 4,652,855 | A | 3/1987 | Weikel | 340/310 |
| 4,675,648 | A | 6/1987 | Roth et al. | 340/310.07 |
| 4,683,450 | A | 7/1987 | Max et al. | 333/202 |
| 4,686,382 | A | 8/1987 | Shuey | 307/149 |
| 4,686,641 | A | 8/1987 | Evans | 364/580 |
| 4,697,166 | A | 9/1987 | Warnagiris et al. | 340/310 R |
| 4,701,945 | A | 10/1987 | Pedigo | 455/402 |
| 4,724,381 | A | 2/1988 | Crimmins | 324/127 |
| 4,745,391 | A | 5/1988 | Gajjar | 340/310 A |
| 4,746,897 | A | 5/1988 | Shuey | 340/310 R |
| 4,749,992 | A | 6/1988 | Fitzmeyer et al. | 340/870.02 |
| 4,766,414 | A | 8/1988 | Shuey | 340/310 A |
| 4,772,870 | A | 9/1988 | Reyes | 340/310 R |
| 4,785,195 | A | 11/1988 | Rochelle et al. | 307/18 |
| 4,800,363 | A | 1/1989 | Braun et al. | 340/310 A |
| 4,835,517 | A | 5/1989 | van der Gracht et al. | 340/310 A |
| 4,903,006 | A | 2/1990 | Boomgaard | 340/310 A |
| 4,904,996 | A | 2/1990 | Fernandes | 340/870.07 |
| 4,912,553 | A | 3/1990 | Pal et al. | 358/86 |
| 4,973,940 | A | 11/1990 | Sakai et al. | 340/310 R |
| 4,979,183 | A | 12/1990 | Cowart | 375/142 |
| 5,006,846 | A | 4/1991 | Granville et al. | 340/870.28 |
| 5,056,107 | A | 10/1991 | Johnson et al. | |
| 5,066,939 | A | 11/1991 | Mansfield, Jr. | |
| 5,068,890 | A | 11/1991 | Nilssen | 379/90 |
| 5,148,144 | A | 9/1992 | Sutterlin et al. | 340/310 A |
| 5,151,838 | A | 9/1992 | Dockery | 340/310 R |
| 5,185,591 | A | 2/1993 | Shuey | 340/310 A |
| 5,191,467 | A | 3/1993 | Kapany et al. | 359/341 |
| 5,210,519 | A | 5/1993 | Moore | 340/310 |
| 5,257,006 | A | 10/1993 | Graham et al. | |
| 5,301,208 | A | 4/1994 | Rhodes | 375/36 |
| 5,319,634 | A | 6/1994 | Bartholomew et al. | |
| 5,351,272 | A | 9/1994 | Abraham | 375/38 |
| 5,359,625 | A | 10/1994 | Vander Mey et al. | 375/1 |
| 5,369,356 | A | 11/1994 | Kinney et al. | 324/142 |
| 5,375,141 | A | 12/1994 | Takahashi | 375/1 |
| 5,398,037 | A * | 3/1995 | Engheta et al. | 343/872 |
| 5,406,249 | A | 4/1995 | Pettus | 340/310.06 |
| 5,410,720 | A | 4/1995 | Osterman | 725/150 |
| 5,426,360 | A | 6/1995 | Maraio et al. | 324/126 |
| 5,432,841 | A | 7/1995 | Rimer | 455/457 |
| 5,448,229 | A | 9/1995 | Lee, Jr. | 340/870.02 |
| 5,461,629 | A | 10/1995 | Sutterlin et al. | 371/30 |
| 5,477,091 | A | 12/1995 | Fiorina et al. | 307/66 |
| 5,481,249 | A | 1/1996 | Sato | 340/2.1 |
| 5,485,040 | A | 1/1996 | Sutterlin | 307/3 |
| 5,497,142 | A | 3/1996 | Chaffanjon | 340/310.06 |
| 5,498,956 | A | 3/1996 | Kinney et al. | 324/142 |
| 4,749,992 | A | 6/1996 | Fitzmeyer et al. | 340/870.02 |
| 5,533,054 | A | 7/1996 | DeAndrea et al. | 375/286 |
| 5,559,377 | A | 9/1996 | Abraham | 307/104 |
| 5,579,221 | A | 11/1996 | Mun | 364/188 |
| 5,579,335 | A | 11/1996 | Sutterlin et al. | 375/200 |
| 5,592,482 | A | 1/1997 | Abraham | 348/8 |
| 5,598,406 | A | 1/1997 | Albrecht et al. | 370/296 |
| 5,616,969 | A | 4/1997 | Morava | 307/91 |
| 5,625,863 | A | 4/1997 | Abraham | 455/3.3 |
| 5,630,204 | A | 5/1997 | Hylton et al. | 455/3.3 |
| 5,640,416 | A | 6/1997 | Chalmers | 375/147 |
| 5,664,002 | A | 9/1997 | Skinner, Sr. | 379/56.2 |
| 5,684,450 | A | 11/1997 | Brown | 340/310.02 |
| 5,691,691 | A | 11/1997 | Merwin et al. | 340/310.02 |
| 5,694,108 | A | 12/1997 | Shuey | 340/310.01 |
| 5,705,974 | A | 1/1998 | Patel et al. | 340/310.08 |
| 5,712,614 | A | 1/1998 | Patel et al. | 340/310.03 |
| 5,717,685 | A | 2/1998 | Abraham | 370/30 |
| 5,726,980 | A | 3/1998 | Rickard | 370/293 |
| 5,748,671 | A | 5/1998 | Sutterlin et al. | 375/206 |
| 5,770,996 | A | 6/1998 | Severson et al. | 340/310.08 |
| 5,774,526 | A | 6/1998 | Propp et al. | 379/90.1 |
| 5,777,544 | A | 7/1998 | Vander Mey et al. | 340/310.06 |
| 5,777,545 | A | 7/1998 | Patel et al. | 341/310.06 |
| 5,777,769 | A | 7/1998 | Coutinho | 359/173 |
| 5,778,116 | A | 7/1998 | Tomich | 385/16 |
| 5,796,607 | A | 8/1998 | Le Van Suu | 364/140.01 |
| 5,802,102 | A | 9/1998 | Davidovici | 375/152 |
| 5,805,053 | A | 9/1998 | Patel et al. | 340/310.01 |
| 5,818,127 | A | 10/1998 | Abraham | 307/106 |
| 5,818,821 | A | 10/1998 | Schurig | 370/293 |
| 5,828,293 | A | 10/1998 | Rickard | 340/310.04 |
| 5,835,005 | A | 11/1998 | Furukawa et al. | 340/310.01 |
| 5,847,447 | A | 12/1998 | Rozin et al. | 257/678 |
| 5,856,776 | A | 1/1999 | Armstrong et al. | 340/310.01 |
| 5,864,284 | A | 1/1999 | Sanderson et al. | 340/310.01 |
| 5,870,016 | A | 2/1999 | Shresthe | 340/310.01 |
| 5,880,677 | A | 3/1999 | Lestician | 340/825.06 |
| 5,881,098 | A | 3/1999 | Tzou | 375/152 |
| 5,892,430 | A | 4/1999 | Wiesman et al. | 340/310.01 |
| 5,929,750 | A | 7/1999 | Brown | 340/310.02 |
| 5,933,071 | A | 8/1999 | Brown | 340/310.01 |
| 5,933,073 | A | 8/1999 | Shuey | 340/310.07 |
| 5,937,003 | A | 8/1999 | Sutterlin et al. | 375/208 |
| 5,937,342 | A | 8/1999 | Kline | 455/402 |
| 5,949,327 | A | 9/1999 | Brown | 340/310.01 |
| 5,952,914 | A | 9/1999 | Wynn | 340/310.01 |
| 5,963,585 | A | 10/1999 | Omura et al. | 375/207 |
| 5,977,650 | A | 11/1999 | Rickard et al. | 307/3 |
| 5,978,371 | A | 11/1999 | Mason, Jr. et al. | 370/389 |
| 5,982,276 | A | 11/1999 | Stewart | 340/310.01 |
| 5,994,998 | A | 11/1999 | Fisher et al. | 340/310.01 |
| 5,994,999 | A | 11/1999 | Ebersohl | 340/310.01 |
| 6,014,386 | A | 1/2000 | Abraham | 370/485 |
| 6,023,106 | A | 2/2000 | Abraham | 307/3 |
| 6,037,678 | A | 3/2000 | Rickard | 307/89 |
| 6,037,857 | A | 3/2000 | Behrens et al. | 340/310.03 |

| | | | | |
|---|---|---|---|---|
| 6,040,759 | A | 3/2000 | Sanderson | 340/310.01 |
| 6,091,932 | A | 7/2000 | Langlais | 455/5.1 |
| 6,104,707 | A | 8/2000 | Abraham | 370/295 |
| 6,130,896 | A | 10/2000 | Lueker et al. | 370/469 |
| 6,140,911 | A | 10/2000 | Fisher et al. | 340/310.01 |
| 6,141,634 | A | 10/2000 | Flint et al. | 703/18 |
| 6,144,292 | A | 11/2000 | Brown | 340/310.02 |
| 6,151,330 | A | 11/2000 | Liberman | 370/449 |
| 6,151,480 | A | 11/2000 | Fischer et al. | |
| 6,157,292 | A | 12/2000 | Piercy et al. | 340/310.01 |
| 6,172,597 | B1 | 1/2001 | Brown | 340/310.02 |
| 6,175,860 | B1 | 1/2001 | Gaucher | 709/208 |
| 6,177,849 | B1 | 1/2001 | Barsellotti et al. | 333/177 |
| 6,212,658 | B1 | 4/2001 | Le Van Suu | 714/749 |
| 6,226,166 | B1 | 5/2001 | Gumley et al. | 361/118 |
| 6,229,434 | B1 | 5/2001 | Knapp et al. | 340/310.01 |
| 6,239,722 | B1 | 5/2001 | Colton et al. | 340/870.02 |
| 6,243,413 | B1 | 6/2001 | Beukema | 375/222 |
| 6,243,571 | B1 | 6/2001 | Bullock et al. | 455/402 |
| 6,282,405 | B1 | 8/2001 | Brown | 725/79 |
| 6,297,729 | B1 | 10/2001 | Abali et al. | 340/310.01 |
| 6,297,730 | B1 | 10/2001 | Dickinson | 340/310.01 |
| 6,304,231 | B1 * | 10/2001 | Reed et al. | 343/873 |
| 6,317,031 | B1 | 11/2001 | Rickard | 340/310.03 |
| 6,331,814 | B1 | 12/2001 | Albano et al. | 340/310.01 |
| 6,346,875 | B1 | 2/2002 | Puckette et al. | |
| 6,373,376 | B1 | 4/2002 | Adams et al. | 340/310.01 |
| 6,373,377 | B1 | 4/2002 | Sacca et al. | |
| 6,396,391 | B1 | 5/2002 | Binder | 340/310.01 |
| 6,396,392 | B1 | 5/2002 | Abraham | 340/310.01 |
| 6,404,773 | B1 | 6/2002 | Williams et al. | 370/463 |
| 6,407,987 | B1 | 6/2002 | Abraham | 370/295 |
| 6,414,578 | B1 | 7/2002 | Jitaru | 336/170 |
| 6,417,762 | B1 | 7/2002 | Comer | |
| 6,425,852 | B1 | 7/2002 | Epstein et al. | 600/13 |
| 6,441,723 | B1 | 8/2002 | Mansfield, Jr. et al. | 340/310.01 |
| 6,449,318 | B1 | 9/2002 | Rumbaugh | 375/309 |
| 6,452,482 | B1 | 9/2002 | Cern | 340/310.01 |
| 6,480,510 | B1 | 11/2002 | Binder | 370/502 |
| 6,486,747 | B1 | 11/2002 | DeCramer et al. | 333/25 |
| 6,492,897 | B1 | 12/2002 | Mowery, Jr. | 340/310.01 |
| 6,496,104 | B1 | 12/2002 | Kline | 340/310.01 |
| 6,504,357 | B1 | 1/2003 | Hemminger et al. | 340/310.01 |
| 6,507,573 | B1 | 1/2003 | Brandt et al. | 370/335 |
| 6,515,485 | B1 | 2/2003 | Bullock et al. | 324/601 |
| 6,522,626 | B1 | 2/2003 | Greenwood | 370/208 |
| 6,549,120 | B1 | 4/2003 | deBuda | 340/310.01 |
| 6,563,465 | B1 * | 5/2003 | Frecska | 343/700 MS |
| 6,590,493 | B1 | 7/2003 | Rasimas | 340/310.01 |
| 6,646,447 | B1 | 11/2003 | Cern et al. | 324/539 |
| 6,668,058 | B1 | 12/2003 | Grimes | 379/322 |
| 6,771,775 | B1 | 8/2004 | Widmer | |
| 6,842,459 | B1 | 1/2005 | Binder | |
| 6,952,159 | B1 | 10/2005 | Muller | |
| 6,956,464 | B1 | 10/2005 | Wang et al. | |
| 6,965,303 | B1 | 11/2005 | Mollenkopf | |
| 6,975,212 | B1 | 12/2005 | Crenshaw et al. | |
| 2001/0038329 | A1 | 11/2001 | Diamanti et al. | 340/310.01 |
| 2001/0038343 | A1 | 11/2001 | Meyer et al. | 340/870.02 |
| 2001/0052843 | A1 | 12/2001 | Wiesman et al. | 340/310.01 |
| 2001/0054953 | A1 | 12/2001 | Kline | 340/310.01 |
| 2002/0010870 | A1 | 1/2002 | Gardner | 713/300 |
| 2002/0014884 | A1 | 2/2002 | Chung | 324/74 |
| 2002/0027496 | A1 | 3/2002 | Cern | 340/310.01 |
| 2002/0041228 | A1 | 4/2002 | Zhang | 340/310.01 |
| 2002/0048368 | A1 | 4/2002 | Gardner | 380/277 |
| 2002/0060624 | A1 | 5/2002 | Zhang | 340/310.01 |
| 2002/0071452 | A1 | 6/2002 | Abraham | 370/480 |
| 2002/0080010 | A1 | 6/2002 | Zhang | 340/310.06 |
| 2002/0095662 | A1 | 7/2002 | Ashlock et al. | 717/136 |
| 2002/0098867 | A1 | 7/2002 | Meiksen et al. | 455/560 |
| 2002/0098868 | A1 | 7/2002 | Meiksen et al. | 455/560 |
| 2002/0105413 | A1 | 8/2002 | Cern | 340/310.01 |
| 2002/0109585 | A1 | 8/2002 | Sanderson | 340/310.01 |
| 2002/0140547 | A1 | 10/2002 | Litwin, Jr. et al. | 340/310.01 |
| 2002/0171535 | A1 | 11/2002 | Cern | 340/310.07 |
| 2002/0186699 | A1 | 12/2002 | Kwok | |
| 2003/0007576 | A1 | 1/2003 | Alavi et al. | 375/329 |
| 2003/0052770 | A1 | 3/2003 | Mansfield, Jr. et al. | |
| 2003/0062990 | A1 | 4/2003 | Schaeffer, Jr. et al. | |
| 2003/0067910 | A1 | 4/2003 | Razazian et al. | 370/352 |
| 2003/0071719 | A1 | 4/2003 | Crenshaw et al. | |
| 2003/0090368 | A1 | 5/2003 | Ide | 340/310.06 |
| 2003/0103307 | A1 | 6/2003 | Dostert | |
| 2003/0106067 | A1 | 6/2003 | Hoskins et al. | |
| 2003/0107477 | A1 | 6/2003 | Ide | 340/310.01 |
| 2003/0129978 | A1 | 7/2003 | Akiyama et al. | 455/426.1 |
| 2003/0133420 | A1 | 7/2003 | Haddad | |
| 2003/0149784 | A1 | 8/2003 | Ide | 709/231 |
| 2003/0160684 | A1 | 8/2003 | Cern | 340/310.01 |
| 2003/0184433 | A1 | 10/2003 | Zalitzky et al. | 340/310.06 |
| 2003/0201759 | A1 | 10/2003 | Cern | 323/247 |
| 2003/0201873 | A1 | 10/2003 | Cern | 340/310.07 |
| 2003/0210135 | A1 | 11/2003 | Cern | 340/310.07 |
| 2003/0210734 | A1 | 11/2003 | Kaku | 375/148 |
| 2003/0222747 | A1 | 12/2003 | Perkinson et al. | 336/178 |
| 2003/0222748 | A1 | 12/2003 | Cern et al. | 336/178 |
| 2003/0224784 | A1 | 12/2003 | Hung et al. | 455/426.2 |
| 2003/0232599 | A1 | 12/2003 | Dostert | 455/66.1 |
| 2004/0001438 | A1 | 1/2004 | Aretz | 370/232 |
| 2004/0001499 | A1 | 1/2004 | Patella et al. | 370/412 |
| 2004/0022304 | A1 | 2/2004 | Santhoff et al. | 375/219 |
| 2004/0032320 | A1 | 2/2004 | Zalitzky et al. | 340/310.01 |
| 2004/0047335 | A1 | 3/2004 | Proctor et al. | 370/351 |
| 2004/0110483 | A1 | 6/2004 | Mollenkopf | 455/402 |
| 2004/0176026 | A1 | 9/2004 | Gainey et al. | |
| 2004/0178888 | A1 | 9/2004 | Hales et al. | |
| 2004/0196144 | A1 | 10/2004 | Crenshaw et al. | |
| 2004/0198453 | A1 | 10/2004 | Cutrer et al. | |
| 2004/0223470 | A1 | 11/2004 | Smith | |
| 2004/0227622 | A1 | 11/2004 | Giannini et al. | 340/310.01 |
| 2004/0227623 | A1 | 11/2004 | Pozsgay | |
| 2004/0233928 | A1 | 11/2004 | Pozsgay | |
| 2004/0239522 | A1 * | 12/2004 | Gallagher | 340/870.02 |
| 2005/0046550 | A1 | 3/2005 | Crenshaw et al. | |
| 2005/0055729 | A1 | 3/2005 | Atad et al. | |
| 2005/0068915 | A1 | 3/2005 | Atad et al. | |
| 2005/0076149 | A1 * | 4/2005 | McKown et al. | 709/249 |
| 2005/0085259 | A1 | 4/2005 | Conner et al. | |
| 2005/0111533 | A1 * | 5/2005 | Berkman et al. | 375/220 |
| 2005/0128057 | A1 | 6/2005 | Mansfield et al. | 340/310.01 |
| 2005/0164666 | A1 | 7/2005 | Lang et al. | |
| 2005/0226200 | A1 | 10/2005 | Askildsen et al. | |
| 2005/0239400 | A1 | 10/2005 | Narikawa | |
| 2005/0249245 | A1 | 11/2005 | Hazani et al. | |
| 2005/0251401 | A1 | 11/2005 | Shuey | |
| 2005/0259668 | A1 | 11/2005 | Kim | |
| 2006/0017324 | A1 | 1/2006 | Pace et al. | |
| 2006/0034330 | A1 | 2/2006 | Iwamura | |
| 2006/0038660 | A1 | 2/2006 | Doumuki et al. | |
| 2006/0049693 | A1 | 3/2006 | Abraham et al. | |
| 2006/0072695 | A1 | 4/2006 | Iwamura | |
| 2006/0073805 | A1 | 4/2006 | Zumkeller et al. | |

FOREIGN PATENT DOCUMENTS

| | | | |
|---|---|---|---|
| DE | 100 08 602 | A1 | 6/2001 |
| DE | 100 12 235 | C2 | 12/2001 |
| DE | 100 47 648 | A1 | 4/2002 |
| DE | 100 61 584 | A1 | 6/2002 |
| DE | 100 61 586 | A1 | 6/2002 |
| DE | 101 00 181 | A1 | 7/2002 |
| DE | 101 03 530 | A1 | 8/2002 |
| DE | 100 59 564 | A1 | 9/2002 |
| DE | 100 48 348 | C2 | 11/2002 |
| DE | 101 190 039 | A1 | 12/2002 |

| | | | |
|---|---|---|---|
| DE | 101 190 040 | A1 | 12/2002 |
| DE | 100 26 930 | C2 | 1/2003 |
| DE | 100 26 931 | C2 | 1/2003 |
| DE | 100 42 958 | C2 | 1/2003 |
| DE | 101 47 918 | A1 | 4/2003 |
| DE | 101 47 916 | C1 | 5/2003 |
| DE | 101 46 982 | C1 | 6/2003 |
| DE | 101 47 915 | C1 | 6/2003 |
| DE | 101 47 913 | C1 | 7/2003 |
| EP | 0 141 673 | A2 | 5/1985 |
| EP | 0 581 351 | A1 | 2/1994 |
| EP | 0 470 185 | B1 | 11/1995 |
| EP | 0 822 721 | A2 | 2/1998 |
| EP | 0 822 721 | A3 | 2/1998 |
| EP | 0 913 955 | A2 | 5/1999 |
| EP | 0 933 833 | A2 | 8/1999 |
| EP | 0 933 883 | A3 | 8/1999 |
| EP | 0 948 143 | A2 | 10/1999 |
| EP | 0 959 569 | A1 | 11/1999 |
| EP | 1 011 235 | A2 | 6/2000 |
| EP | 1 014 640 | A2 | 6/2000 |
| EP | 1 043 866 | A2 | 10/2000 |
| EP | 1 043 866 | A3 | 10/2000 |
| EP | 1 075 091 | A1 | 2/2001 |
| EP | 0 916 194 | B1 | 9/2001 |
| EP | 1 011 235 | A3 | 5/2002 |
| EP | 1 213 849 | A1 | 6/2002 |
| EP | 1 217 760 | A1 | 6/2002 |
| EP | 1 014 640 | A3 | 7/2002 |
| EP | 1 021 866 | B1 | 10/2002 |
| EP | 1 251 646 | A2 | 10/2002 |
| ES | 2 122 920 | A1 | 12/1998 |
| FR | 2 326 087 | | 7/1976 |
| GB | 1 548 652 | | 7/1979 |
| GB | 2 101 857 | A | 1/1983 |
| GB | 2 293 950 | A | 4/1996 |
| GB | 2 315 937 | A | 2/1998 |
| GB | 2 331 683 | A | 5/1999 |
| GB | 2 335 335 | A | 9/1999 |
| GB | 2 341 776 | A | 3/2000 |
| GB | 2 342 264 | A | 4/2000 |
| GB | 2 347 601 | A | 9/2000 |
| JP | 1276933 | | 11/1989 |
| NZ | 276741 | | 7/1998 |
| WO | 84/01481 | A1 | 4/1984 |
| WO | 90/13950 | A2 | 11/1990 |
| WO | 92/16920 | A1 | 10/1992 |
| WO | 93/07693 | A1 | 4/1993 |
| WO | 95/29536 | A1 | 11/1995 |
| WO | 98/33258 | A2 | 7/1998 |
| WO | 98/33258 | A3 | 7/1998 |
| WO | 98/40980 | A1 | 9/1998 |
| WO | 99/59261 | A1 | 11/1999 |
| WO | 00/16496 | A2 | 3/2000 |
| WO | 00/59076 | A1 | 10/2000 |
| WO | 00/60701 | A1 | 10/2000 |
| WO | 00/60822 | A1 | 10/2000 |
| WO | 01/08321 | A1 | 2/2001 |
| WO | 01/43305 | A1 | 6/2001 |
| WO | 01/50625 | A2 | 7/2001 |
| WO | 01/50625 | A3 | 7/2001 |
| WO | 01/50628 | A1 | 7/2001 |
| WO | 01/50629 | A1 | 7/2001 |
| WO | 01/63787 | A1 | 8/2001 |
| WO | 01/82497 | A1 | 11/2001 |
| WO | 02/17509 | A1 | 2/2002 |
| WO | 02/37712 | A1 | 5/2002 |
| WO | 02/054605 | A1 | 7/2002 |
| WO | 02/089352 | A1 | 11/2002 |
| WO | 02/089353 | A1 | 11/2002 |
| WO | 03/30396 | A2 | 4/2003 |
| WO | 03/034608 | A2 | 4/2003 |
| WO | 03/039022 | A1 | 5/2003 |
| WO | 03/040732 | A2 | 5/2003 |
| WO | 2004/008656 | A1 | 1/2004 |
| WO | 2004/021600 | A1 | 3/2004 |

OTHER PUBLICATIONS

"Centralized Commercial Building Applications with the Lonworks ® PLT-21 Power Line Transceiver", *Lonworks Engineering Bulletin, Echelon,* (Apr. 1997), 1-22.

"Demand Side Management with LONWORKS® Power Line Transceivers", *LONWORKS Engineering Bulletin,* (Dec. 1996), 1-36.

U.S. Appl. No. 09/765,910, filed Jan. 19, 2001, Kline.

U.S. Appl. No. 09/805,638, filed Mar. 14, 2001, Kline.

U.S. Appl. No. 09/835,532, filed Apr. 16, 2001, Kline.

U.S. Appl. No. 09/837,972, filed Apr. 19, 2001, Kline et al.

U.S. Appl. No. 09/912,633, filed Jul. 25, 2001, Kline.

U.S. Appl. No. 09/915,459, filed Jul. 26, 2001, Kline.

U.S. Appl. No. 09/924,730, filed Aug. 8, 2001, Kline.

U.S. Appl. No. 10/016,998, filed Dec. 14, 2001, Kline.

U.S. Appl. No. 10/036,914, filed Dec. 21, 2001, Mollenkopf et al.

U.S. Appl. No. 10/075,708, filed Feb. 14, 2002, Kline.

U.S. Appl. No. 10/075,332, filed Feb. 14, 2002, Kline.

U.S. Appl. No. 10/150,694, filed May 16, 2002, Gidge.

U.S. Appl. No. 10/165,992, filed Jun. 10, 2002, Kline.

U.S. Appl. No. 10/176,500, filed Jun. 21, 2002, Pridmore, Jr. et al.

U.S. Appl. No. 10/293,799, filed Nov. 13, 2002, Huebner.

U.S. Appl. No. 10/292,745, filed Nov. 12, 2002, Cope et al.

U.S. Appl. No. 10/292,714, filed Nov. 12, 2002, Cope.

U.S. Appl. No. 10/315,725, filed Dec. 10, 2002, Cope et al.

U.S. Appl. No. 10/319,317, filed Dec. 13, 2002, Mollenkopf et al.

U.S. Appl. No. 10/348,164, filed Jan. 21, 2003, Cope et al.

U.S. Appl. No. 10/385,899, filed Mar. 10, 2003, Mollenkopf.

U.S. Appl. No. 10/436,778, filed May 13, 2003, Giannini et al.

U.S. Appl. No. 10/434,024, filed May 8, 2003, Corcoran et al.

U.S. Appl. No. 10/626,308, filed Jul. 23, 2003, Berkman et al.

U.S. Appl. No. 10/641,689, filed Aug. 14, 2003, White, II et al.

U.S. Appl. No. 10/675,409, filed Sep. 30, 2003, Mollenkopf.

Patent Abstracts of Japan, Japanese Publication No. 10200544 A2, published Jul. 31, 1998, (Matsushita Electric Works, LTD).

Tohoku Electric Power, Co., Inc., "Tohoku Electric Develops High-Speed Communications System Using Power Distribution Lines,"*Tohoku Currents*, Spring 1998, 8(1) , 2 pages (http://www.tohoku-epco.co.jp/profil/kurozu/c_vol8_1/art04.htm).

Power Line Communications Conference entitled, "PLC, A New Competitor in Broadband Internet Access," Dec. 11-12, 2001, Washington, D.C., 60 pages.

Rivkin, S. R., "Co-Evolution of Electric & Telecommunications Networks," *The Electricity Journal*, May 1998, 71-76.

Marketing Assessment Presentation entitled "Powerline Telecommunications," The Shpigler Group for CITI PLT, Jul. 16, 2002, 9 pages.

Campbell, C., presentation entitled "Building a Business Case for PLC: Lessons Learned From the Communication Industry Trenches," KPMG Consulting, Jul. 16, 2002, 5 pages.

"Embedded Power Line Carrier Modem," Archnet Electronic Technology, http://www.archnetco.com/english/product/ATL90.htm, 2001, 3 pages.

"Archnet: Automatic Meter Reading System Power Line Carrier Communication", www.archnetco.com/english/product/product_sl.htm, 3 pages, date is not available.

"Power Line Communications Solutions", www.echelon.com/products/oem/transceivers/powerline/default.htm, 2 pages, date is not available.

"Texas Instruments: System Block Diagrams; Power Line Communication (Generic)", http://focus.ti.com/docs/apps/catalog/resources/blockdiagram.jhtml?bdId=638, 1 page, date is not available.

Feduschak, N.A., "Waiting in the Wings: Is Powerline Technology Ready to Compete with Cable?", March 2001, www.cabletoday.com/ic2/archives/0301/0301powerline.htm, 5 pages.

"Signalling on Low-Voltage Electrical Installations in the Frequency Band 3kHz to 148.5kHz-Part 4: Filters at the Interface of the Indoor and Outdoor Electricity Network", *CLC SC 105A* (*Secretariat*) May 1992, 62, 1-11.
"Intellon Corporation Test Summary for Transformerless Coupler Study", *Intellon No News Wires*, Dec. 24, 1998, DOT/NHTSA Order No. DTNH22-98-P-07632, pp. 1-18.
EMETCON *Automated Distribution System*, ABB Power T & D Company, Inc., Jan. 1990, Raleigh, North Carolina, No. B-919A, 14 pages.
"Dedicated Passive Backbone for Power Line Communications", *IBM Technical Disclosure Bulletin*, Jul. 1997, 40(7), 183-185.
Coaxial Feeder Cables [Engineering Notes], *PYE Telecommunications Limited Publication Ref No. TSP507/1*, Jun. 1975, Cambridge, England, 15 pages.
"Centralized Commercial Building Applications with the Lonworks® PLT-21 Power Line Transceiver", *Lonworks Engineering Bulletin*, Echelon, Apr. 1997, pp. 1-22.
Plexeon Logistics, Inc., "Power Line Communications", www.plexeon.com/power.html, 2 pages, date is not available.
"EMETCON Automated Distribution System: Communications Guide", *Westinghouse ABB Power T & D Company Technical Manual 42-6001A*, Sep. 1989, 55 pages.
Abraham, K.C. et al., "A Novel High-Speed PLC Communication Modem", *IEEE Transactions on Power Delivery*, 1992, 7(4), 1760-1768.
J.M. Barstow., "A Carrier Telephone System for Rural Service", *AIEE Transactions*, 1947, 66, 301-307.
Chang, S.S.L., "Power-Line Carrier", *Fundamentals Handbook of Electrical and Computer Engineering*, vol. II-Communication, Control, Devices and Systems, John Wiley & Sons, 617-627, date is not available.
Chen, Y-F. et al. "Baseband Transceiver Design of a 128-Kbps Power-Line Modem for Household Applications", *IEEE Transactions on Power Delivery*, 2002, 17(2), 338-344.
Coakley, N.G. et al., "Real-Time Control of a Servosytem Using the Inverter-Fed Power Lines to Communicate Sensor Feedback", *IEEE Transactions on Industrial Electronics*, 1999, 46(2), 360-369.
Esmailian, T. et al., "A Discrete Multitone Power Line Communication System", *Department of Electrical and Computer Engineering*, University of Toronto, Ontario Canada, 2000 IEEE, pp. 2953-2956.
Kawamura, A. et al., "Autonomous Decentralized Manufacturing System Using High-speed Network with Inductive Tansmission of Data and Power", *IEEE*, 1996, 940-945.
Kilbourne, B. "EEI Electric Perspectives: The Final Connection", www.eei.org/ep/editorial/Jul-01/0701conenct.htm, 7 pages, date is not available.
Kim, W-O., et al., "A Control Network Architecture Based on EIA-709.1 Protocol for Power Line Data Communications", *IEEE Transactions on Consumer Electronics*, 2002, 48(3), 650-655.
Lim, C.K. et al., "Development of a Test Bed for High-Speed Power Line Communications", School of Electrical and Electronic Engineering, Nanyang Technological University, Singapore, *IEEE*, 2000, 451-456.
Lokken, G. et al., "The Proposed Wisconsin electric Power Company Load Management System Using Power Line Carrier Over Distribution Lines", *1976 National Telecommunications Conference, IEEE*, 1976, 2.2-12.2-3.
Marthe, E. et al., "Indoor Radiated Emission Associated with Power Line Communication Systems", *Swiss Federal Institute of Technology Power Systems Laboratory IEEE*, 2001, 517-520.
Naredo, J.L. et al., "Design of Power Line Carrier Systems on Multitransposed Delta Transmission Lines", *IEEE Transactions on Power Delivery*, 1991, 6(3), 952-958.
Nichols, K., "Build a Pair of Line-Carrier Modems", *CRC Electronics-Radio Electronics*, 1988, 87-91.
Okazaki, H, et al., "A Transmitting, and Receiving Method for CDMA Communications Over Indoor Electrical Power Lines", *IEEE*, 1998, pp. VI-522-VI-528.
B. Don Russell, "Communication Alternatives for Distribution Metering and Load Management", *IEEE Transactions on Power Apparatus and Systems*, 1980, vol. PAS-99(4), pp. 1448-1455.
Sado, WN. et al., "Personal Communication on Residential Power lines- Assessment of Channel Parameters", *IEEE*, 532-537, date is not available.
LONWORKS Engineering Bulletin, "Demand Side Management with LONWORKS® Power Line Transceivers," Dec. 1996, 36 pages.
HomePlug™ Powerline Alliance, HomePlug Initital Draft Medium Interface Specification, May 19, 2000, 109 pages.
HomePlug™ Powerline Alliance, HomePlug Initital Draft Medium Interface Specification, Jul. 27, 2000, 109 pages.
HomePlug™ Powerline Alliance, HomePlug 1.01 Specification, Dec. 1, 2001, 139 pages.
Summary of an IEEE Guide for Power-Line Carrier Applications, A Report by the Power System Communications Committee, *IEEE Transactions on Power Apparatus and Systems*, vol. PAS-99, No. 6, Nov./Dec. 1980, pp. 2334-2337.
De Wilde, W. R. et al., "Upwards to a Reliable Bi-Directional Communication Link on the LV Power Supplies for Utility Services: Field Tests in Belgium," pp. 168-172, date is not available.
Tanaka, M., "Transmission Characteristics of a Power Line Used for Data Communications at High Frequencies," IEEE Transactions on Consumer Electronics, Feb. 1989, vol. 35, No. 1, pp. 37-42.
Hasler, E. F. et al., "Communication Systems Using Bundle Conductor Overhead Power Lines," IEEE Transactions on Power Apparatus and Systems, Mar./Apr. 1975, vol. PAS-94, No. 2, pp. 344-349.
IEEE Guide for Power-Line Carrier Applications, ANSI/IEEE Std 643-1980, © 1980 by The Institute of Electrical and Electronics Engineers, Inc., pp. 1-80.
Hatori, M. et al., "Home Informatization and Standardization of Home Bus," IEEE Transactions on Consumer Electronics, Aug. 1986, vol. CE-32, No. 3, pp. 542-549.
Hunt, J. M. et al., "Electrical Energy Monitoring and Control System for the Home," IEEE Transactions on Consumer Electronics, Aug. 1986, vol. CE-32, No. 3, pp. 578-583.
Gutzwiller, F. W. et al., "Homenet: A Control Network for Consumer Applications," IEEE Transactions on Consumer Electronics, Aug. 1983, vol. CE-29, No. 3, pp. 297-304.
Burrascano, P. et al., "Digital Signal Transmission on Power Line Carrier Channels: An Introduction," IEEE Transactions on Power Delivery, Jan. 1987, vol. PWRD-2, No. 1, pp. 50-56.
Burr, A. G. et al., "Effect of HF Broadcast Interference on PowerLine Telecommunications Above 1 Mhz," © 1998 IEEE, pp. 2870-2875.
Onunga, J. et al., "Distribution Line Communications Using CSMA Access Control with Priority Acknowledgements," IEEE Transactions on Power Delivery, Apr. 1989, vol. 4, No. 2, pp. 878-886.
Tanaka, M., "High Frequency Noise Power Spectrum, Impedance and Transmission Loss of Power Line in Japan on Intrabuilding Power Line Communications," IEEE Transactions on Consumer Electronics, May 1988, vol. 34, No. 2, pp. 321-326.
Meng, H. et al., "A Transmission Line Model for High-Frequency Power Line Communication Channel," © 2002 IEEE, pp. 1290-1295.
Burrascano, P. et al., "Performance Evaluation of Digital Signal Transmission Channels on Coronating Power Lines," © 1988 IEEE, pp. 365-368.
DiClementi, D. A. et al., "Electrical Distribution System Power Line Characterization," © 1996 IEEE, pp. 271-276.
Abraham, K. C. et al., "A Novel High-Speed PLC Communication Modem," IEEE Transactions on Power Delivery, Oct. 1992, vol. 7, No. 4, pp. 1760-1768.
Yoshitoshi, M. et al., "Proposed Interface Specifications for Home Bus," IEEE Transactions on Consumer Electronics, Aug. 1986, vol. CE-32, No. 3, pp. 550-557.
O'Neal, Jr., J. B., "The Residential Power Circuit as a Communication Medium," IEEE Transactions on Consumer Electronics, Aug. 1986, vol. CE-32, No. 3, pp. 567-577.
Dostert, K., "EMC Aspects of High Speed Powerline Communications," Proceedings of the 15th International Wroclaw Symposium and Exhibition on Electromagnetic Capability, Jun. 27-30, 2000; Wroclaw, Poland, pp. 98-102.

Piety, R. A., "Intrabuilding Data Transmission Using Power-Line Wiring," Hewlett-Packard Journal, May 1987, pp. 35-40.
"ABB joins Main.net's subsidiary, PPC, as shareholder and strategic partner for Power Line Communications," Mannheim, Germany/Kfar Saba, Israel, Oct. 8, 2002, 2 pages.
International Search dated Jul. 16, 2001, from PCT/US01/12699.
Written Opinion dated May 15, 2002, from PCT/US01/12699.
International Search Report dated Oct. 22, 2001, from PCT/US01/12291.
International Search Report dated Jun. 5, 2002, from PCT/US01/48064.
International Search Report dated Jun. 24, 2002, from PCT/US02/04310.
Written Opinion dated Aug. 20, 2003, from PCT/US02/04310.
International Search Report dated Aug. 7, 2002, from PCT/US02/04300.
Written Opinion dated Mar. 21, 2003, from PCT/US02/04300.
International Search Report dated May 2, 1991, from PCT/US01/01810.

* cited by examiner

TRANSFORMER ANTENNA DEVICE AND METHOD OF USING THE SAME

FIELD OF THE INVENTION

The present invention generally relates to data communications over a power distribution system and more particularly to a transformer antenna device for facilitating communications through a power line communication system and method of using the same.

BACKGROUND OF THE INVENTION

Well-established power distribution systems exist throughout most of the United States, and other countries, which provide power to customers via power lines. With some modification, the infrastructure of the existing power distribution systems can be used to provide data communication in addition to power delivery, thereby forming a power line communication system (PLCS). In other words, existing power lines, that already have been run to many homes and offices, can be used to carry data signals to and from the homes and offices. These data signals are communicated on and off the power lines at various points in the power line communication system, such as, for example, near homes, offices, Internet service providers, and the like.

Power distribution systems include numerous sections, which transmit power at different voltages. The transition from one section to another typically is accomplished with a transformer. The sections of the power distribution system that are connected to the customers premises typically are low voltage (LV) sections having a voltage between 100 volts(V) and 240V, depending on the system. In the United States, the LV section typically is about 120V. The sections of the power distribution system that provide the power to the LV sections are referred to as the medium voltage (MV) sections. The voltage of the MV section is in the range of 1,000V to 100,000V. The transition from the MV section to the LV section of the power distribution system typically is accomplished with a distribution transformer, which converts the higher voltage of the MV section to the lower voltage of the LV section.

Power system transformers are one obstacle to using power distribution lines for data communication. Transformers act as a low-pass filter, passing the low frequency signals (e.g., the 50 or 60 Hz) power signals and impeding the high frequency signals (e.g., frequencies typically used for data communication). As such, power line communication systems face the challenge of communicating the data signals around, or through, the distribution transformers.

In addition, the power lines that provide power to and direct power from these power transformers are not designed to provide high speed data communications. For example, certain power distribution systems employ the use of underground MV lines that connect to pad mounted distribution transformers. The pad mounted distribution transformers then feed power to residences using underground LV feeds. Up to ten (and sometimes more) customer premises will typically receive power from one distribution transformer via their respective LV power lines. Often, underground power lines provide an even greater barrier to the transmission of data signals than do overhead lines. In addition, underground power lines are buried and, therefore, may be inaccessible except for near pad mounted transformers or taps (from an overhead line). Yet, in an effort to lessen the interruption of power caused by downed power lines and for aesthetic purposes, more and more transmission systems employ underground power lines. As a result, greater numbers of power line communication systems must be designed to overcome the additional barriers created by underground transmission and distribution systems.

In addition, components of the power line communication system, such as the distribution transformer bypass device (BD), must electrically isolate the MV power signal from the LV power lines and the customer premises. These and other advantages are provided by various embodiments of the present invention.

SUMMARY OF THE INVENTION

The invention contemplates an antenna device, system and method of installing an antenna device for receiving a wireless signal at a pad mounted electrical transformer. The novel device includes an antenna capable of communicating the wireless signal and that is embedded in a protective material. The protective material facilitates attachment to the pad mounted electrical transformer as well as preventing access to the antenna. The material may be emissive and/or insulative. In addition, the device may include a conductor that passes from the antenna and through an enclosure of the pad mounted transformer. The conductor may be communicatively coupled to a first communication device that provides communication to a customer premises that is electrically coupled to the pad mounted electrical transformer. Alternatively, the antenna may be communicatively coupled to at least one low voltage power line. Also, the antenna may receive signals in a predetermined frequency range, and the material may be emissive within the predetermined frequency range. The antenna may have a substantially planar face, be disk shaped, be a wire, and/or be made of a substantially flat rectangular metallic material.

BRIEF DESCRIPTION OF THE DRAWINGS

The invention is further described in the detailed description that follows, by reference to the noted drawings by way of non-limiting illustrative embodiments of the invention, in which like reference numerals represent similar parts throughout the drawings. As should be understood, however, the invention is not limited to the precise arrangements and instrumentalities shown. In the drawings.

DETAILED DESCRIPTION OF ILLUSTRATIVE EMBODIMENTS

In the following description, for purposes of explanation and not limitation, specific details are set forth, such as particular networks, communication systems, computers, terminals, devices, components, techniques, data and network protocols, software products and systems, operating systems, development interfaces, hardware, etc. in order to provide a thorough understanding of the present invention.

However, it will be apparent to one skilled in the art that the present invention may be practiced in other embodiments that depart from these specific details. Detailed descriptions of well-known networks, communication systems, computers, terminals, devices, components, techniques, data and network protocols, software products and systems, operating systems, development interfaces, and hardware are omitted so as not to obscure the description of the present invention.

System Architecture and General Design Concepts

Figure 1:
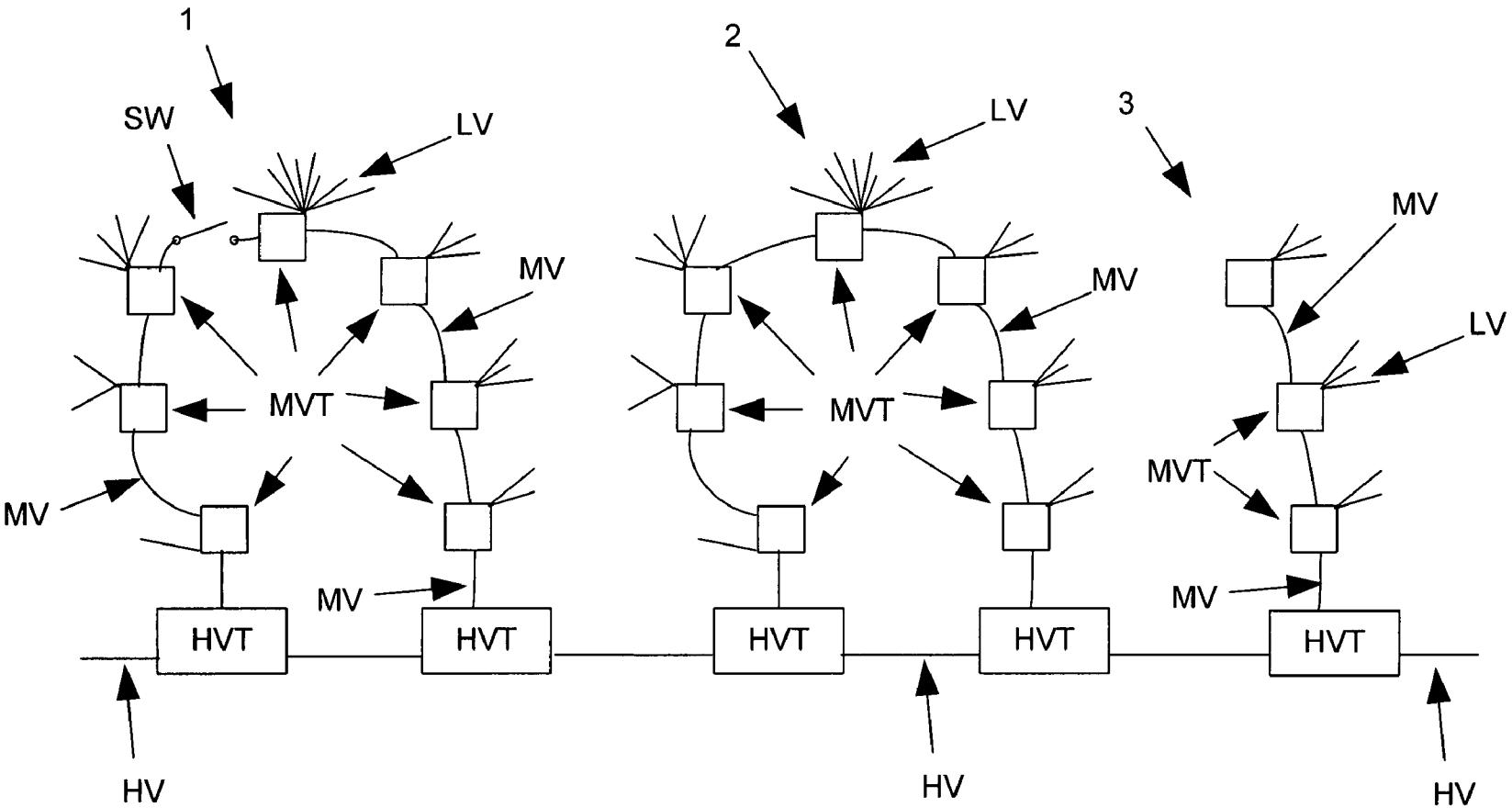
FIG. 1 is a diagram of an exemplary power distribution system with which the present invention may be employed.

FIG. 1 discloses a representative underground residential power distribution (URD) system comprising a high voltage (HV) power line that is connected to a plurality of high voltage transformers (HVT) that set down the high voltage to medium voltage. Typical voltages found on HV power lines range from 69 kilovolts (kV) to in excess of 800 kV.

Referring to FIG. 1, the HVT steps down the high voltage to medium voltage for distribution on the medium voltage power lines which are connected one or more the distribution transformers (DTs). Each DT further steps down the voltage to low voltage (LV) and, therefore, is connected to one or more LV power lines, each of which may extend to a customer premises (not shown in FIG. 1). As discussed, MV typically ranges from about 1000 V to about 100 kV and LV typically ranges from about 100V to about 240 V.

A distribution transformer may function to distribute one, two, three, or more phase currents to the customer premises, depending upon the demands of the user. In the United States, for example, these local distribution transformers typically feed anywhere from one to ten homes, depending upon the concentration of the customer premises in a particular area. Distribution transformers may be pole-top transformers located on a utility pole, pad-mounted transformers located on the ground (as shown), or transformers located under ground level. It should be appreciated that the invention is not limited to any particular transformer or distribution system configuration.

The URD network of FIG. 1 includes two types of topographies. The first type is commonly referred to as a ring or U topology as represented by networks 1 and 2. The ring network may be a U shaped with each leg of the U being connected to a HVT. In addition, the ring network may include a switch (SW) that connects both sides of the ring together (as in network 1). Consequently, should either HVT fail (or a break in the MV power line occur) the switch may be closed so that the entire MV network receives power. Other such networks may not include a switch (as in network 2).

Another type of topology is referred to as a radial or star network as shown in network 3 in which one or more MV power lines extends away from a single HVT. While the illustrations of these networks depict a single MV power line, a radial or ring network configuration may include multiple MV power line conductors and/or cables extending from each HVT (e.g., be three phase or have multiple three phase cables).

The antenna device of the present invention may form part of a PLCS to communicate signals to and from communication devices at the customer premises through the LV power line. In addition, the antenna device of the present invention may facilitate the communication of data signals along the MV power line with 1) other power line communication devices; 2) one or more backhaul points; 3) one or more power line servers; and/or 4) devices on a network such as the Internet.

Power Line Communication System

One example of such a PLCS may include a communication device at one or more DTs that communicates data signals from proximate the distribution transformer with devices at the customer premises. Thus, the communication device is the gateway to the LV power line subnet (i.e., the devices that are communicatively coupled to the LV power lines). In some embodiments the communication device may be a transformer bypass device (BD) providing a path for data around the transformer, which would otherwise filter (or attenuate) the data signal.

In this embodiment, the communication device provides communication services for the user, which may include security management, routing of Internet protocol (IP) packets, filtering data, access control, service level monitoring, signal processing and modulation/demodulation of signals transmitted over the power lines.

This example PLCS also includes backhaul points designated that act as an interface and gateway between a PLCS and a traditional non-power line telecommunication network. One or more backhaul points are communicatively coupled to an aggregation point (AP) that in many embodiments may be the point of presence to the Internet. The backhaul point may be connected to the AP using any available mechanism, including fiber optic conductors, T-carrier, Synchronous Optical Network (SONET), or wireless techniques well known to those skilled in the art. Thus, the backhaul point may include a transceiver suited for communicating through the communication medium such as a wireless or fiber optic transceiver.

The AP may include a conventional Internet Protocol (IP) data packet router and may be directly connected to an Internet backbone thereby providing access to the Internet. Alternatively, the AP may be connected to a core router (not shown), which provides access to the Internet, or other communication network. Depending on the configuration of the PLCS, a plurality of APs may be connected to a single core router which provides Internet access. The core router (or AP as the case may be) may route voice traffic to and from a voice service provider and route Internet traffic to and from an Internet service provider. The routing of packets to the appropriate provider may be determined by any suitable means such as by including information in the data packets to determine whether a packet is voice. If the packet is voice, the packet may be routed to the voice service provider and, if not, the packet may be routed to the Internet service provider. Similarly, the packet may include information (which may be a portion of the address) to determine whether a packet is Internet data. If the packet is Internet data, the packet may be routed to the Internet service provider and, if not, the packet may be routed to the voice service provider.

In some PLCS embodiments, there may a distribution point (not shown) between the backhaul point and the AP. The distribution point, which may be a router, may be coupled to a plurality of backhaul points and provides routing functions between its backhaul points and its AP. In one example embodiment, a plurality of backhaul points are connected to each distribution point and each distribution point (of which there is a plurality) is coupled to the AP, which provides access to the Internet.

The PLCS also may include a power line server (PLS) (not shown) that is a computer system with memory for storing a database of information about the PLCS and includes a network element manager (NEM) that monitors and controls the PLCS. The PLS allows network operations personnel to provision users and network equipment, manage customer data, and monitor system status, performance and usage. The PLS may reside at a remote operations center to oversee a group of communication devices via the Internet. The PLS may provide an Internet identity to the network devices by assigning the devices (e.g., user devices, BDs, the LV modems and MV modems of BDs, backhaul points, and AP), an IP address and storing the IP address and other device identifying information (e.g., the device's location, address, serial number, etc.) in its memory. In addition, the PLS may approve or deny user devices authorization requests, command status reports and measurements from the BDs, repeaters, and backhaul points, and provide application software upgrades to the communication devices (e.g., BDs, backhaul points, repeaters, and other devices). The PLS, by collecting electric power distribution information and interfacing with utilities' back-end computer systems may provide enhanced distribution services such as automated meter reading, outage detection, load balancing, distribution automation, Volt/Volt-Amp Reactance (Volt/VAr) management, and other similar functions. The PLS also may be connected to one or more APs and/or core routers directly or through the Internet and therefore can communicate with any of the BDs, repeaters, user devices, and backhaul points through the respective AP and/or core router. Detailed descriptions of a BD, backhaul point, AP, DP, PLS and other components and characteristics of a PLCS are provided in U.S. patent application Ser. No. 10/675,409, filed Sep. 30, 2003, entitled "Power Line Communication System and Method," which is herein incorporated by reference in its entirety.

At the user end of the PLCS, data flow originates from a user device, which provides the data to a power line interface device (PLID) (sometimes referred to as a power line modem), which is well-known in the art.

Various electrical circuits within the customer's premises distribute power and data signals within the customer premises. The customer draws power on demand by plugging a device into a power outlet. In a similar manner, the customer may plug the PLID into a power outlet to digitally connect user devices to communicate data signals carried by the power wiring. The PLID thus serves as an interface for user devices to access the PLCS. The PLID can have a variety of interfaces for customer data appliances. For example, a PLID can include a RJ-11 Plain Old Telephone Service (POTS) connector, an RS-232 connector, a USB connector, a 10 Base-T connector, RJ-45 connector, and the like. In this manner, a customer can connect a variety of user devices to the PLCS. Further, multiple PLIDs can be plugged into power outlets throughout the customer premises, with each PLID communicating over the same wiring internal to the customer premises.

The user device connected to the PLID may be any device cable of supplying data for transmission (or for receiving such data) including, but not limited to a computer, a telephone, a telephone answering machine, a fax, a digital cable box (e.g., for processing digital audio and video, which may then be supplied to a conventional television and for transmitting requests for video programming), a video game, a stereo, a videophone, a television (which may be a digital television), a video recording device, a home network device, a utility meter, or other device.

The PLID transmits the data received from the user device through the customer LV power line to a BD and provides data received from the LV power line to the user device. The PLID may also be integrated with the user device, which may be a computer. In addition, the functions of the PLID may be integrated into a smart utility meter such as a gas meter, electric meter, water meter, or other utility meter to thereby provide automated meter reading (AMR).

For upstream communications, the BD typically transmits the data to the backhaul point, which, in turn, transmits the data to the AP. The AP then transmits the data to the appropriate destination (perhaps via a core router), which may be a network destination (such as an Internet address) in which case the packets are transmitted to, and pass through, numerous routers (herein routers are mean to include both network routers and switches) in order to arrive at the desired destination. Downstream communications typically traverse the devices in the opposite sequence.

Figure 2:
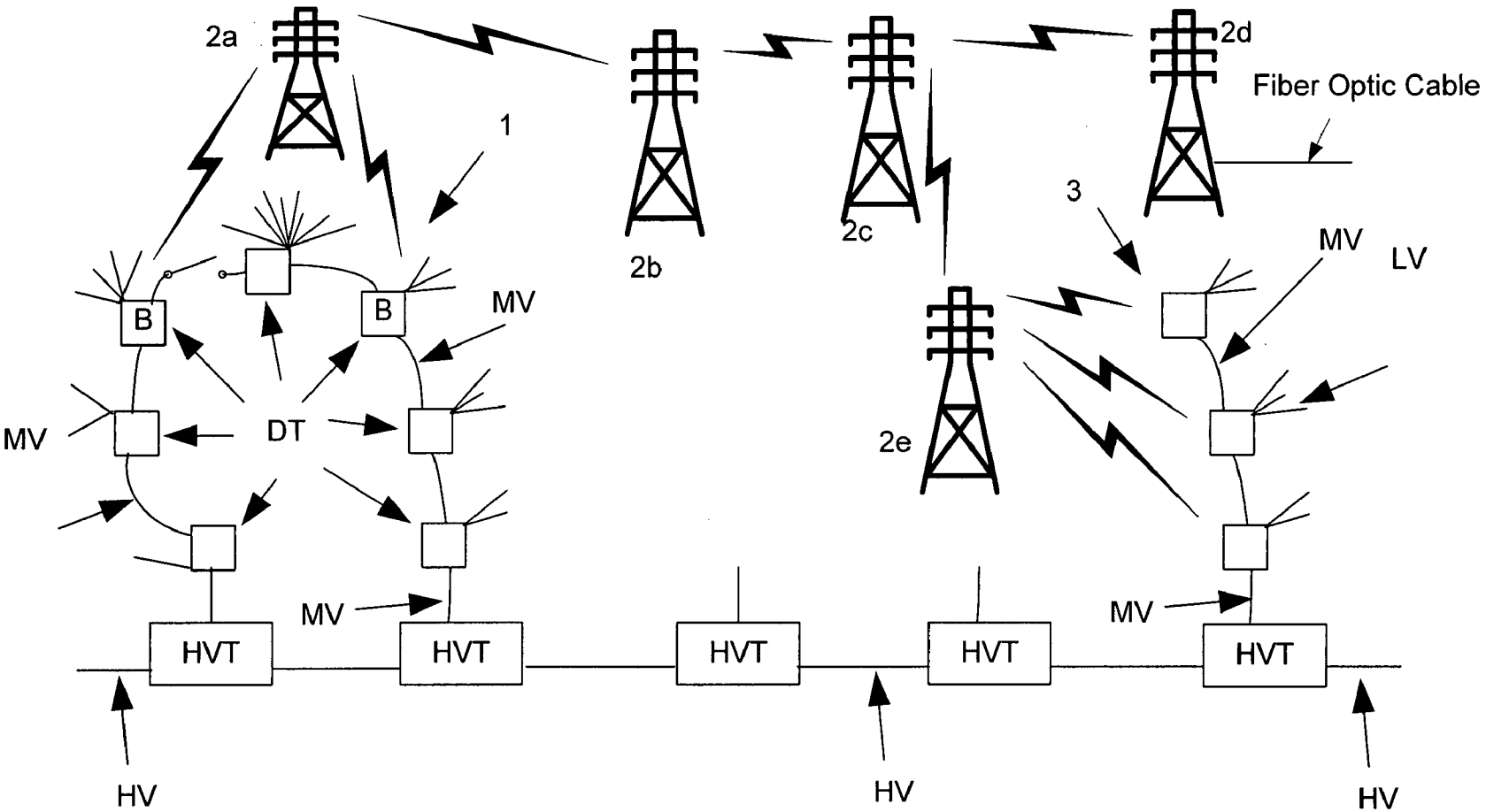
FIG. 2 is a diagram of the exemplary power distribution system of FIG. 1 modified to operate as a power line communication system, in accordance with an embodiment of the present invention.

As discussed, one embodiment of the present invention comprises an antenna device that may be mounted to a transformer enclosure. Referring to FIG. 2, a communication device is installed at each DT (except those labeled with a B). For ease of illustration the communications devices in FIG. 2 are not shown separately from the DT. In network 1, each communication device is in communication with a backhaul point via the MV power line. This example PLCS includes two backhaul points designated by the B at two DTs in network 1. Data from the communication devices may be communicated directly to and from the backhaul point, or may be repeated (or amplified) by those communication devices between the communication device and the backhaul point.

The backhaul points B are configured to provide an upstream communication link that is wireless and that is provided via use of one embodiment of the present invention. Specifically, the backhaul points B are in communication with wireless repeater 2*a*, which is in wireless communication with wireless repeater 2*b*, which is in wireless communication with wireless repeater 2*c*, which is in wireless communication with wireless repeater 2*d*, which is in communication with a point of presence (or other upstream device) via a fiber optic cable. Wireless repeaters 2*a*, 2*b*, 2*c*, and 2*d* may be daisy-chained together for bi-directional communications via time division multiplexing and/or frequency division multiplexing (e.g., a separate upstream and downstream frequency band) and may use any suitable license or unlicensed band. Such frequencies may include 2 GHz, 5 GHz, and/or 60 GHz bands. Protocols (and bands) used may include 802.11a,b, or g and/or 802.16x. Wireless repeaters 2*a*, 2*b*, 2*c*, and 2*d* may also be comprised one (or two) antenna device 305 that is attached to a tower, transformer enclosure, or other structure.

Network 3 comprises three DTs with each having a communication device (not shown separately). Each of these communication devices is configured to provide an upstream wireless communication link with wireless repeater 2*e* that is provided via use of one embodiment of the present invention. Thus, network 3 may not utilize the MV power lines to provide communications. In network 1 and 3, the communication devices communicate with other devices in the customer premises via the low voltage power lines or, alternately, via another wireless link that may use the same or a different antenna (in the case of network 3).

Figure 3:
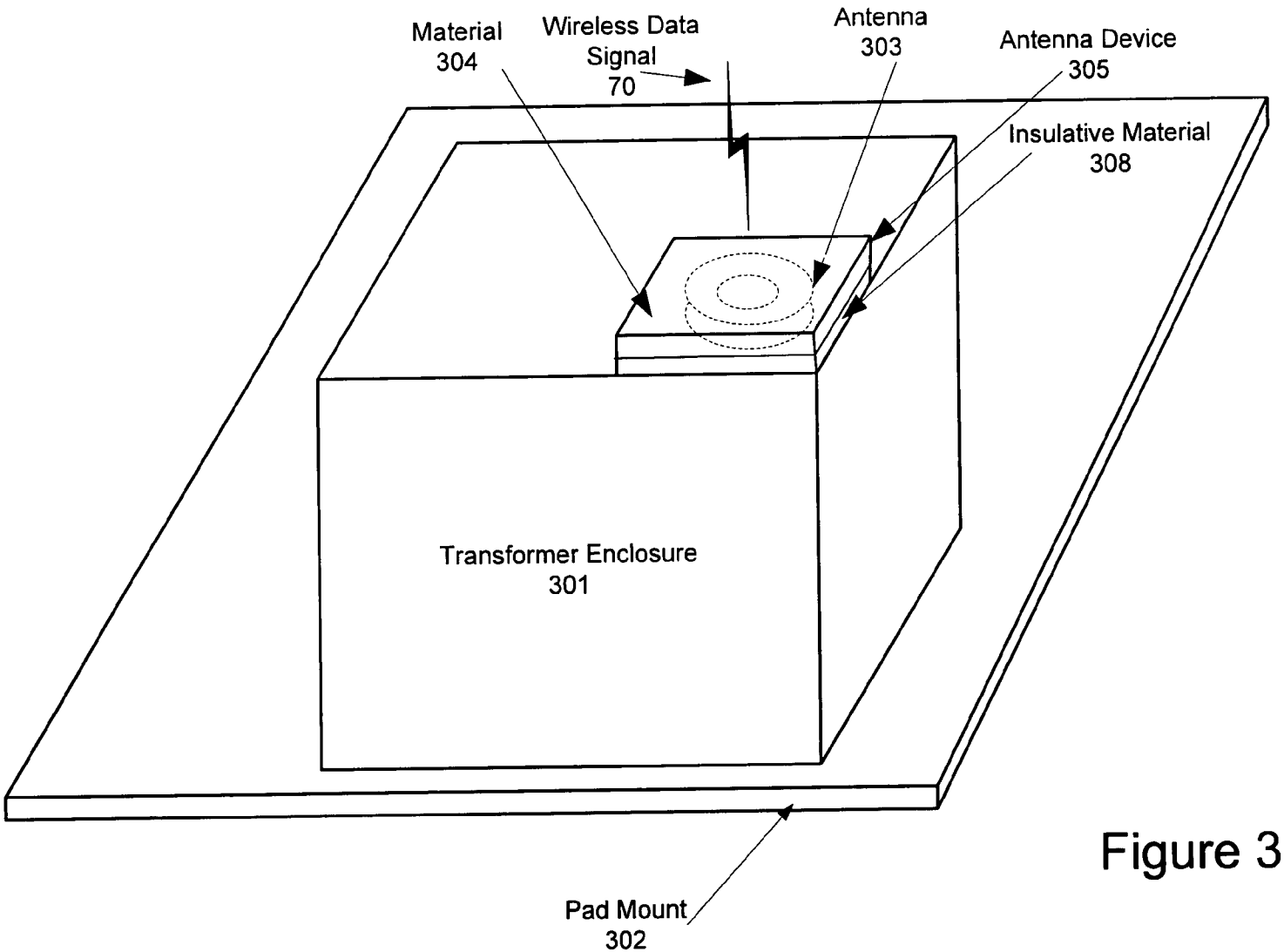
FIG. 3 illustrates an antenna device, in accordance with an embodiment of the present invention.
Figure 4:
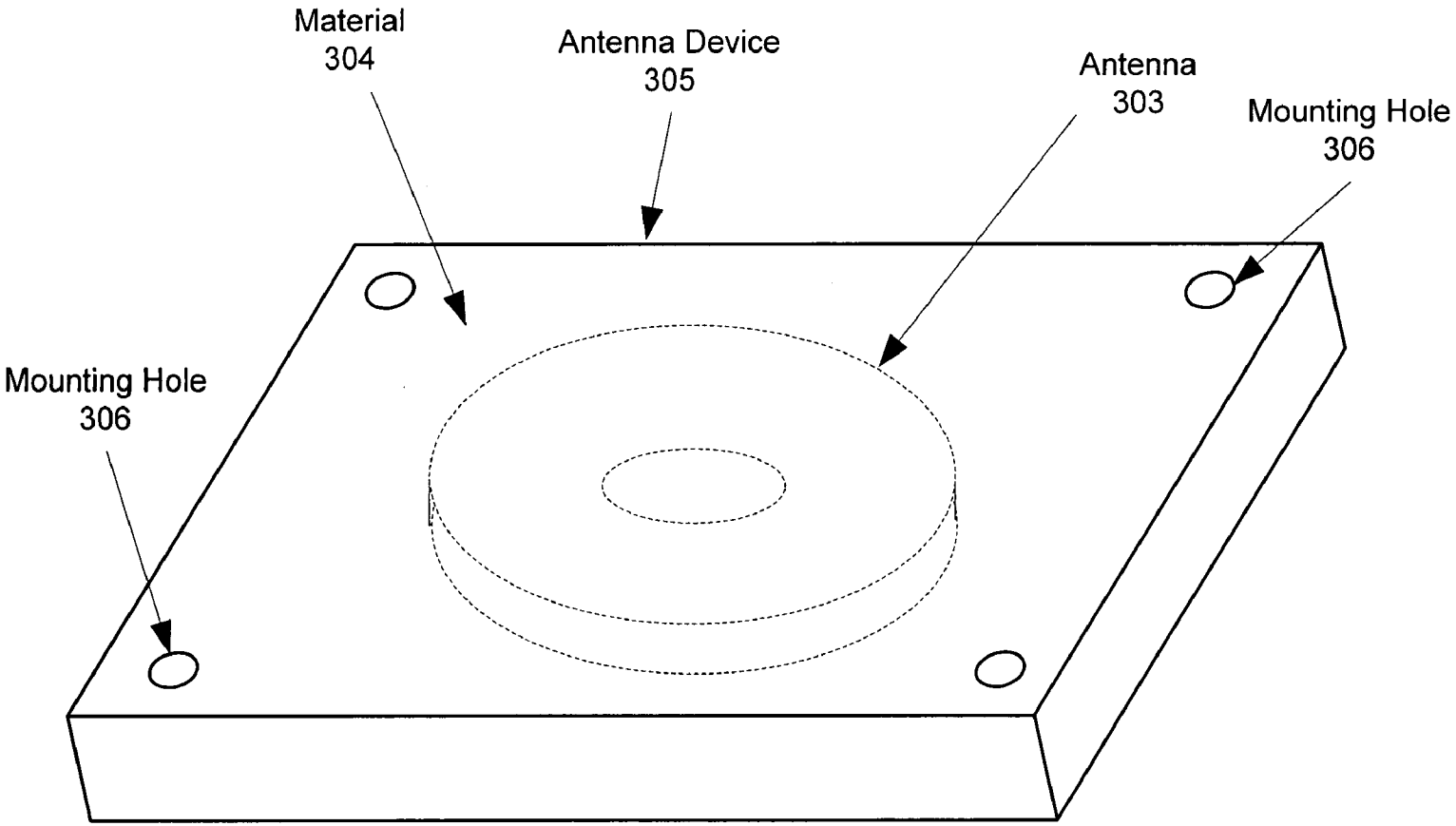
FIG. 4 illustrates an antenna device, in accordance with an embodiment of the present invention.

FIGS. 3 and 4 illustrate an antenna device 305, in accordance with an embodiment of the present invention. As shown in FIG. 3, a pad mount transformer enclosure 301 rests on a pad mount 302. It should be appreciated that the construction and operation of transformer 301 is not limited to any particular configuration.

As illustrated in FIG. 3, antenna device 305 may comprise an antenna 303 that is embedded in a protective material 304. Antenna 303 is depicted with dashed lines in FIG. 3 to illustrate that, in one embodiment, antenna 303 may be completely embedded by material 304. Although antenna 303 is illustrated as having a disk-like shape, it should be appreciated that antenna 303 may take any form including having a substantially planar face and/or a substantially flat rectangular metallic material, or be wire-like. Antenna 303 and the protective material 304 are not limited to any particular size, shape, construction or manufacture.

It is well known to coat antennas with environmentally protective coating. In such devices, the coating forms a silhouette of the antenna. In contrast, the present invention may be embedded. The material 304 in which the antenna 303 is embedded provides structure strength to the antenna device 305 and may provide a means for attaching the communication device to the transformer enclosure. Because the transformer enclosure 301 may be at ground level and, therefore, accessible to passers by, embedding the antenna 303 provides a means for disguising the antenna (e.g., the communication device may simply appear as a rectangular block whose function is not apparent) to discourage theft and/or vandalism (if so desired). In addition, provided the material has the appropriate characteristics (high strength, fire resistant, hard), the antenna device may be virtually impervious to manual destruction attempts. Thus, the material may prevent structural deformation of the antenna.

Antenna 303 may be designed or constructed to receive and/or transmit wireless data signal 70. In certain embodiments a communication device with which the antenna device 305 is communicatively coupled may be located within transformer enclosure 301 (e.g., mounted to the inside of transformer enclosure 301). In this case, a conductor (not shown) may connect to antenna 303, extend from material 304, and pass through transformer enclosure 301 and connect to the electronics of the communication device. Also, the communication device may be located outside transformer enclosure 301 (e.g., attached to outside of transformer enclosure 301 or buried), such that connection with antenna 303 may be accomplished external to transformer enclosure 301. As discussed, the communication device with which antenna device 305 is communicatively coupled may be in communication with and pass the data signal to a low voltage power line network that extends to the customer premises. In another embodiment, the conductor (communicatively coupled to antenna 303) may be coupled (e.g., perhaps via an amplifier and/or band pass filter) to one or more of the low voltage lines through which the transformer in transformer enclosure 301 is connected and that supplies power to customer premises.

Material 304 may be constructed of any material that permits antenna 303 to receive and/or transmit wireless data signal 70 without substantial additional interferences (e.g., any emissive material). Material 304 may be manufactured in part from rubber, plastic, and/or Mylar-based materials, for example. Also, material 304 may be any size or shape, for example, the material may be at least one-half inch thick. The material 304 may be sized to be substantially equal to or slightly larger (e.g., 1 mm or 1 cm larger) than the three dimensions (height, width, and length) of antenna 303. For example, if the antenna measures 300 cm high, the material may be molded to be 300 cm high (with antenna 303 flush with the top and bottom of the surface material 304) or 305 cm (with antenna 303 just below the surface of material 304). Some or all of the dimensions of material 304 may be much larger than the corresponding dimension of the antenna 303. For example, it may be desirable to design the communication device so that it has the same width and length as the surface of the transformer enclosure 301 to which it will be mounted, or one fourth, or one ninth of those dimensions.

As shown in FIG. 4, in one embodiment, antenna 303 may be embedded within material 304, such that material 304 completely or partially encases antenna 303. In addition, and as shown in FIG. 4, the shape of the antenna device 305 (and external shape of material 304) may be different shape than that of antenna 303. For example, in this example embodiment, antenna 303 is substantially disk shaped and the communication device 305 is shaped substantially as a rectangular box. In other embodiments, antenna device 305 may be shaped more similar to that of antenna 303 (e.g., be disked shape, but without the center depression of antenna 303).

Antenna 303 may be positioned anywhere within (or even partially within) material 304. Thus in some embodiments, the transmitting and receiving surface of antenna 303 may be exposed and may be co-planar with the surrounding material 304. Also, antenna 303 may be directionally oriented or tilted within material 304. In general, the location, orientation, direction and any other pertinent characteristics of the placement of antenna 303 within material 304 may be designed to achieve certain desired communication characteristics (e.g., maximum reception and transmission) with devices with which antenna 303 is designed to communicate.

Further, an insulative and/or non-emissive material 308 may be located between antenna 303 and transformer enclosure 301 to prevent the operation of antenna 303 to be interfered with by the operation and/or components of transformer in transformer enclosure 301. Also, material 304 itself may be both emissive and insulative. Material 304 may be of such a material, size and shape such that the material is emissive within a predetermined frequency range that is consistent with the frequency range in which the antenna is designed to operate.

Because pad mounted transformers typically are located in accessible areas that are subject to unwanted tampering, material 304 may prevent undesired access to the antenna, while facilitating the attachment of antenna 303 to transformer 301. In addition, material 304 and antenna 303 may be made to appear as part of the transformer itself (e.g., painted the same color), so as to avoid detection (and potential theft or vandalism).

In one embodiment, a method of installing antenna 303 to transformer 301 is contemplated. In this embodiment, installation personnel may use communication testing techniques, for example, to determine a location on transformer enclosure 301 on which antenna 303 is most likely to receive and/or transmit the strongest signal, for example from a backhaul point. Also, the installation personnel may orient antenna 303 (e.g., with respect to the wireless transceiver with which the device is to communicate) to achieve greater signal reception and/or transmission of wireless data signal 70. Thus, the antenna device 305 may be installed on the top side of transformer enclosure 301 (as shown in FIG. 3) or on a side of transformer enclosure 301. In addition, if antenna 303 is not oriented symmetrically in material 304, antenna device 305 may be installed so that the orientation of antenna 303 in material 304 is favorable for communications.

Antenna device 305 may be manufactured in two forms—prefabricated and assembled. In the assembled version, once this location and orientation (if any) is determined, the installation personnel may place the antenna at or near the location, and proceed to apply material 304 (or another material) to cover antenna 303 so as to prevent access to the antenna. Material 304 may be applied with an adhesive, for example, or other means of attachment.

In the prefabricated embodiment, as discussed with reference to FIG. 4, antenna 303 may be prefabricated to be embedded within material 304, and may be attached to transformer enclosure 301 using traditional attachment means such as by fastening bolts through the holes in material 304 and holes in the transformer enclosure. Again, the attachment means along with the use of material 304 may prevent tampering of antenna 303. In another embodiment, antenna 303 and material 304 may be included with transformer 301 as part of the transformer manufacturing process. As discussed, it may also be desirable to include a spacer between the antenna device and transformer enclosure 301. A spacer may be installed under only one side of the communication device to facilitate directional tilting of the antenna for improved communications. Alternately, the spacer or a mounting arm may permit mounting of the communication device and antenna in spaced relation to the enclosure thereby permitting better line of sight (e.g., to get around an obstruction) and improved communications.

As an example, installing antenna device 305 may comprise selecting a place and orientation (if necessary) of installation on transformer enclosure 301, drilling mounting apertures that register with mounting holes 306, drilling a communications wire aperture (if necessary), passing the communications wire through the communications wire aperture (if necessary), fastening antenna device 305 to transformer enclosure 301 via the transformer enclosure mounting apertures and mounting holes 306 (e.g., via bolts), and connecting the communications wire to the communication device (which may be inside transformer enclosure 301).

Antenna device 305 may form part of a backhaul point and be configured to communicate with the upstream device (e.g., and AP) and/or a downstream device (such as a bypass device) which may include an antenna device 305 according to the present invention. Consequently, antenna device 305 also may form part of a communication device and be configured to communicate with a backhaul point or with other communication devices. Antenna device 305 and its associated wireless electronics may replace or be in addition to the medium voltage interface of a backhaul point of communication device (e.g., bypass device). Additionally, antenna 305 may be directed to wirelessly communicate with wireless transceivers at one ore more customer premises. Such an application may alleviate the need to communicate over the low voltage power lines and the antenna device (and its associated electronics) may replace or be in addition to the low voltage interface of the communication device.

Thus, depending on the architecture of the PLCS, each communication device and/or backhaul point may comprise two antenna devices 305 (e.g., one for communications upstream and one for communications downstream). The communication devices may be configured to daisy-chain data upstream to, and downstream from, a backhaul point. Alternately, a plurality of backhaul points may be configured to daisy-chain data upstream to, and downstream from, an aggregation point (or distribution point).

In any of the embodiments, it may be desirable to provide a backhaul link (from the backhaul point to the point of presence, the includes a number of wireless repeaters that are daisy chained together to provide a wireless link between a plurality of downstream devices (such as backhaul points) and one or more upstream devices (e.g., an AP).

Antenna device 305 may be configured to communicate via frequency division multiplexing and/or time division multiplexing and in any desirable frequency band (licensed or unlicensed) including but not limited to the 2.4 GHz, 5 GHz, or 60 GHz bands. Thus, antenna device 305 may be configured to communicate via protocols such as IEEE 802.11a, 802.11b, or 802.11g, or 802.16a. Antenna device 305 may also be directional or omni-directional (i.e., non-directional).

In addition to the above, one or more surfaces of material 304 (e.g., the top surface) may include a heating element (embedded near the surface of material 304) to melt ice and snow that comes to rest on antenna device 305. The elements, the position of the elements, and/or the spacing of the elements (e.g., relative to the wavelength of the carrier signals) may be configured to not interfere, impede or degrade the communication signals.

It is to be understood that the foregoing illustrative embodiments have been provided merely for the purpose of explanation and are in no way to be construed as limiting of the invention. Words used herein are words of description and illustration, rather than words of limitation. In addition, the advantages and objectives described herein may not be realized by each and every embodiment practicing the present invention. Further, although the invention has been described herein with reference to particular structure, materials and/or embodiments, the invention is not intended to be limited to the particulars disclosed herein. Rather, the invention extends to all functionally equivalent structures, methods and uses, such as are within the scope of the appended claims.

Those skilled in the art, having the benefit of the teachings of this specification, may affect numerous modifications thereto and changes may be made without departing from the scope and spirit of the invention.

What is claimed is:

1. A device for communicating a data signal in at least one frequency range, the device being disposed at a transformer enclosure housing a pad mounted distribution transformer that forms part of a power distribution system and wherein a first communication device is disposed within the enclosure and communicates over a power line connected to the distribution transformer, comprising:

an antenna capable of communicating the data signal, said antenna having an antenna shape;

a material encasing said antenna and having an external shape different from said antenna shape, wherein said material facilitates attachment to an external surface of the transformer enclosure; and an interface coupling said antenna to the communication device disposed within the transformer enclosure.

2. The device of claim 1, wherein said material is emissive.

3. The device of claim 2, wherein said material is insulative.

4. The device of claim 1, wherein said interface comprises a conductor communicatively coupled to said antenna and that passes through an aperture in the transformer enclosure.

5. The device of claim 4, wherein said conductor is communicatively coupled to the first communication device.

6. The device of claim 5, wherein said first communication device provides communication to a customer premise that is electrically coupled to the transformer in the transformer enclosure.

7. The device of claim 5, wherein the first communication device is a backhaul point.

8. The device of claim 4, wherein said antenna is communicatively coupled to at least one low voltage power line.

9. The device of claim 1, further comprising an insulative material configured to be mounted between said antenna and the transformer enclosure.

10. The device of claim 1, wherein-said material is disposed between said antenna and the transformer enclosure.

11. The device of claim 1, wherein said antenna receives signals in a predetermined frequency range, and wherein said material is emissive within said predetermined frequency range.

12. The device of claim 1, wherein said material has a substantially planar face.

13. The device of claim 1, wherein said antenna is disk-shaped.

14. The device of claim 1, wherein said material is insulative.

15. The device of claim 1, wherein said material comprises at least one of the following: rubber, plastic, and Mylar.

16. The device of claim 1, wherein said material has a thickness that facilitates preventing access to said antenna.

17. The device of claim 1, wherein a first external dimension of said antenna is substantially different than the first external dimension of said material.

18. The device of claim 17, wherein a second external dimension of said antenna is substantially different than the second external dimension of said material.

19. The device of claim 17, wherein said material has a rectangular box shape and said antenna has a disk shape.

20. The device of claim 1, wherein said antenna is directionally oriented within said material.

21. The device of claim 1, wherein said material comprises holes to facilitate mounting to the transformer enclosure.

22. The device of claim 1, wherein said antenna is a substantially flat rectangular metallic material.

23. The device of claim 1, wherein said material prevents structural deformation of said antenna.

24. A system for communicating a wireless signal at a transformer enclosure that houses a pad mounted distribution transformer that forms part of a power distribution system, comprising:

a protective material;

an antenna embedded in said material and located external to the enclosure; and a communication device located within the enclosure and communicatively coupled to the antenna and a power line connected to the distribution transformer.

25. The system of claim 24, wherein said communication device is communicatively coupled to at least one low voltage power line.

26. The system of claim 25, wherein the low voltage power line is electrically coupled to a customer premise.

27. The system of claim 25, wherein the communication device comprises a first communication device, and further comprising a second communication device in communication with said first communication device.

28. The system of claim 27, wherein said first communication device, comprises:

a first modem;

a first router in communication with said first modem; and a first wireless transceiver in communication with said first modem.

29. The system of claim 28, wherein said second communication device, comprises:

a second modem;

a second router in communication with said second modem; and a second wireless transceiver in communication with said second modem.

30. The system of claim 29, wherein said second wireless transceiver uses IEEE standard 802.11.

31. The system of claim 28, wherein said first wireless transceiver uses IEEE standard 802.11.

32. The system of claim 28, wherein said antenna comprises a substantially planar surface.

33. The system of claim 28, wherein said material is emissive.

34. The system of claim 28, further comprising an insulative material located between said antenna and the pad mounted electrical transformer.

35. The system of claim 24, wherein said material is located between said antenna and the pad mounted electrical transformer.

36. The system of claim 28, wherein said antenna receives signals in a predetermined frequency range, and wherein said material is emissive within said predetermined frequency range.

37. The system of claim 28, wherein said antenna is disk-shaped.

38. A system for communicating a data signal at a transformer enclosure of a pad mounted distribution transformer that forms part of a power distribution system, comprising:

an antenna located external to the enclosure;

a communication device located within the enclosure that is disposed at or below ground level; and wherein said communication device comprises a first transceiver communicatively coupled to the antenna and a first modem communicatively coupled to a power line.

39. The system of claim 38, wherein said communication device further comprises a first router in communication with said first modem.

40. The system of claim 38, wherein said first transceiver uses an IEEE 802.11 standard.

41. The system of claim 38, wherein the power line comprises a low voltage power line electrically coupled to a customer premise.

* * * * *

UNITED STATES PATENT AND TRADEMARK OFFICE

CERTIFICATE OF CORRECTION

PATENT NO. : 7,113,134 B1
APPLICATION NO. : 10/799975
DATED : September 26, 2006
INVENTOR(S) : Berkman It is certified that error appears in the above-identified patent and that said Letters Patent is hereby corrected as shown below:

On the face page, in field (56), under "U.S. Patent Documents", in column 1, line 5, after "Stradley" insert -- 179/2.5 --.

On the face page, in field (56), under "U.S. Patent Documents", in column 1, line 12, after "Kabat et al." insert -- 340/147 R --.

On the face page, in field (56), under "U.S. Patent Documents", in column 1, line 19, after "Lusk et al." insert -- 340/310 R --.

On page 2, in field (56), under "U.S. Patent Documents", in column 1, line 1, after "Johnson et al." insert -- 340/310 R --.

On page 2, in field (56), under "U.S. Patent Documents", in column 1, line 2, after "Pascucci et al." insert -- 307/3 --.

On page 2, in field (56), under "U.S. Patent Documents", in column 1, line 7, after "Dorfman" insert -- 179/2.51 --.

On page 2, in field (56), under "U.S. Patent Documents", in column 1, line 69, after "Graham et al." insert -- 340/310A --.

On page 2, in field (56), under "U.S. Patent Documents", in column 1, line 71, after "Bartholomew et al." insert -- 370/18 --.

On page 3, in field (56), under "U.S. Patent Documents", in column 1, line 42, after "6,496,104" delete "B1" and insert -- B2 --, therefor.

On page 4, in field (56), under "Foreign Patent Documents", in column 1, line 16, delete "0 933 833 A2" and insert -- 0 933 883 A2 --, therefor.

On page 5, in field (56), under "Other Publications", in column 1, line 36, delete "Servosytem" and insert -- Servosystem --, therefor.

On page 5, in field (56), under "Other Publications", in column 1, line 44, delete "Tansmission" and insert -- Transmission --, therefor.

On page 5, in field (56), under "Other Publications", in column 2, line 2, delete "lines" and insert -- Lines --, therefor.

UNITED STATES PATENT AND TRADEMARK OFFICE

CERTIFICATE OF CORRECTION

PATENT NO. : 7,113,134 B1
APPLICATION NO. : 10/799975
DATED : September 26, 2006
INVENTOR(S) : Berkman It is certified that error appears in the above-identified patent and that said Letters Patent is hereby corrected as shown below:

In column 3, line 23, delete "100V" and insert -- 100 V --, therefor.

In column 5, line 24, delete "10/675,409," and insert -- 10/675,409 (Attorney Docket No. CRNT-0206), --, therefor.

In column 11, line 1, in Claim 10, delete "wherein-said" and insert -- wherein said --, therefor.

Signed and Sealed this

Twenty-seventh Day of February, 2007

JON W. DUDAS
*Director of the United States Patent and Trademark Office*